United States Patent [19]

Seppala

[11] Patent Number: 4,753,365

[45] Date of Patent: Jun. 28, 1988

[54] LID WITH REMOVABLE TAB

[75] Inventor: Eino E. Seppala, Waukegan, Ill.

[73] Assignee: Solo Cup Company, Urbana, Ill.

[21] Appl. No.: 69,314

[22] Filed: Jul. 2, 1987

[51] Int. Cl.[4] ..... B65D 41/46

[52] U.S. Cl. ..... 220/90.4; 220/220; 220/380; 206/508; 229/906.1

[58] Field of Search ..... 220/90.2, 90.4, 268, 220/270, 380; 206/508; 229/906.1

[56] References Cited

U.S. PATENT DOCUMENTS

| | | | |
|---|---|---|---|
| Re. 31,650 | 8/1984 | Serritella | 229/7 R |
| 1,931,991 | 10/1933 | Mergentheim | 230/7 |
| 2,661,889 | 12/1953 | Phinney | 229/14 |
| 3,171,580 | 3/1965 | Davis et al. | 229/906.1 |
| 3,977,562 | 8/1976 | Wedzik | 220/270 |
| 4,056,210 | 11/1977 | Boyle | 220/90.4 |
| 4,106,660 | 8/1978 | Boyle | 220/90.4 |
| 4,331,255 | 5/1982 | Fournier | 220/259 |
| 4,438,865 | 3/1984 | Scattaregia | 220/270 |
| 4,473,167 | 9/1984 | Bailey | 220/90.4 |
| 4,489,848 | 12/1984 | Braude | 220/90.4 |
| 4,589,569 | 5/1986 | Clements | 220/380 |

*Primary Examiner*—George T. Hall

*Attorney, Agent, or Firm*—Fitch, Even, Tabin & Flannery

[57] ABSTRACT

A lid for a drinking cup having a removable tab which includes a horizontal wall and a vertical wall extending downwardly from the horizontal wall at the inner end of the horizontal portion. A recess is disposed immediately inward of the removable tab to permit engagement of the vertical portion by the finger of a user. The recess preferably includes a bottom wall which slopes downwardly and outwardly from the center of the lid to the vertical portion of the tab and is separated by a slit from the bottom of the vertical wall of the tab.

7 Claims, 3 Drawing Sheets

LID WITH REMOVABLE TAB

BACKGROUND OF THE INVENTION

The invention relates generally to disposable lids for drinking cups, and more particularly to a disposable lid having a portion which may be removed to provide a drinking opening.

In providing a lid with a portion which is removable to provide an opening, several considerations must be taken into account. First of all, it is desirable that the removable portion be capable of removal smoothly and easily without requiring excessive skill on the part of the user and without releasing suddenly. In some lids with removable tabs, removal of the tab often causes jerking of the cup and partial spillage or splashing of the contents, due to the manner in which the tab is attached to the lid.

A second consideration is that the lid be inexpensive to manufacture. Because the lids are typically used in very large numbers, small savings in cost of manufacture can be significant.

It is also desirable that the lid be capable of stacking with like lids without binding, and that the lid provide a good seal with a cup on which it is mounted so that one can drink through the opening without encountering spillage around the opening.

It is a general object of the invention to provide a disposable lid which includes the above features. Further objects of the invention are set forth below.

SUMMARY OF THE INVENTION

The invention comprises a drinking cup lid with a removable tab which includes a generally horizontal wall extending inward from the periphery of the lid between a pair of generally radial score lines, and a generally vertical wall extending downward at the inner end of the horizontal wall. The removable portion may be folded during removal along the line where the horizontal wall joins the vertical wall. The lid preferably provides a substantially planar support surface which is free of upwardly extending projections so that the lid may provide stable support for a cup, permitting stacking of a second cup on top of a first cup equipped with the lid of the invention. The horizontal wall of the removable portion is preferably coplanar with, and part of, the support surface. A recess immediately inward of the generally vertical wall of the removable tab permits access to the vertical wall for engagement by a finger or thumb of the user.

DETAILED DESCRIPTION OF THE PREFERRED EMBODIMENT

Figure 1:
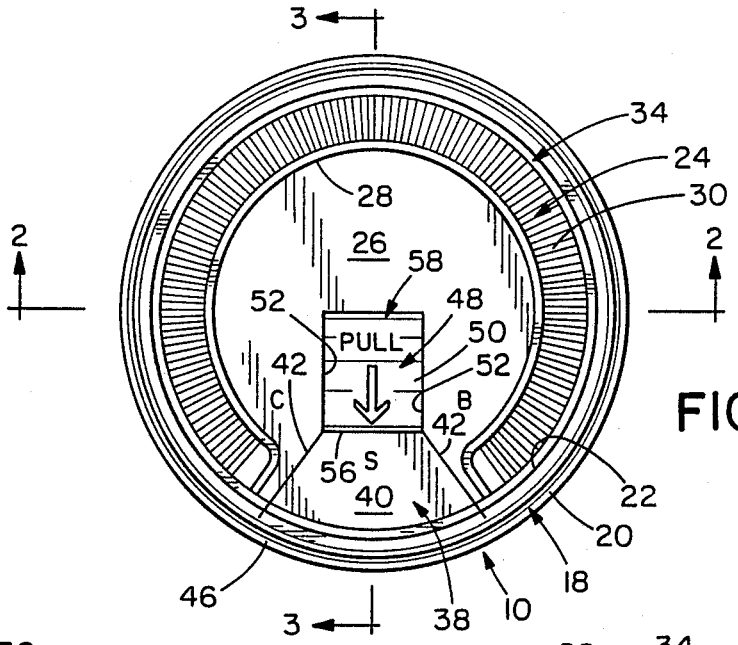
FIG. 1 is a plan view of a lid in accordance with the invention.
Figure 2:
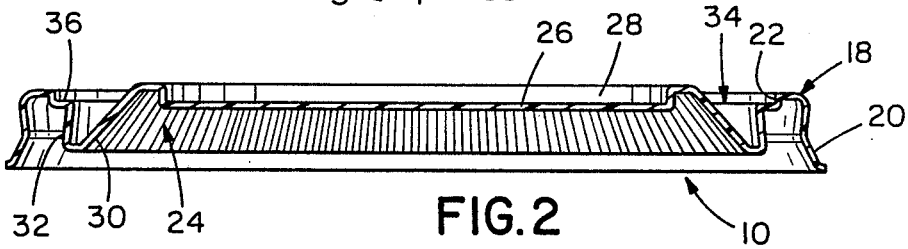
FIG. 2 is a sectional view taken substantially along line 2—2 in FIG. 1.
Figure 3:
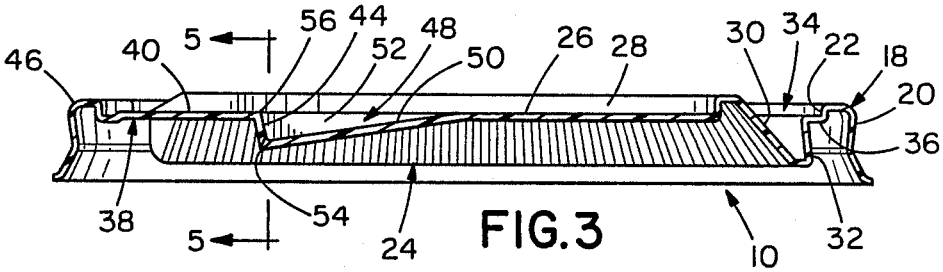
FIG. 3 is a sectional view taken substantially along lines 3—3 in FIG. 1.
Figure 4:
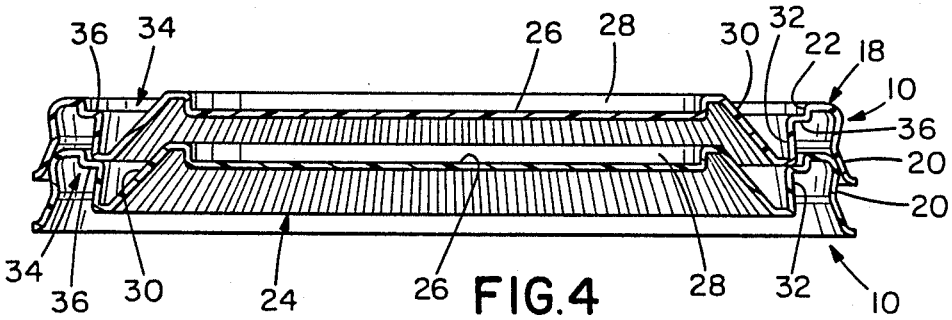
FIG. 4 is a sectional elevational view illustrating a lid in accordance with the invention stacked upon another lid in accordance with the invention, each of the lids being shown in section in accordance with the view of FIG. 2.
Figure 5:
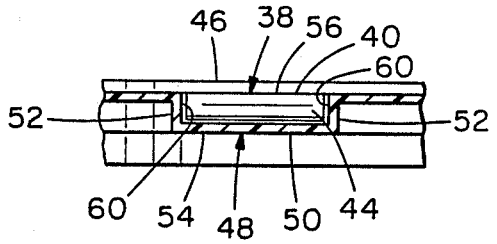
FIG. 5 is a fragmentary sectional view taken substantially along line 5—5 FIG. 3.

The invention is generally embodied in a lid 10 for a drinking cup. For convenience of description, the terms "upward", "downward", "horizontal", and "vertical", are used herein to refer to the lid in an orientation in which it is in place on an upright cup. The terms "inward" and "outward" refer to radial position, with the term "inward" denoting a direction toward the center of the lid, and the term "outward" used to describe a direction away from the center of the lid.

The lid of the invention may be used with cups of various types, and is particularly useful with disposable cups used as carry-out containers for beverages such as coffee and the like. Such cups are commonly made of Styrofoam or paper. An example of such a cup is illustrated at 12 in FIG. 10.

The illustrated cup 12 has a generally circular upper lip or rim 14 with a bead formed thereon. The lid 10 provides a cover for the cup 12 which inhibits spillage and reduces heat transfer between the beverage and the surrounding environment, and is secured in place on the cup by an annular mounting portion 18 which engages the upper lip 14 of the cup.

The mounting portion 18 preferably includes a generally frustoconical skirt portion 20 which extends downwardly and outwardly about the periphery of the lid, and an annular inner wall 22 located immediately inward of the skirt portion which extends downward and inward from the top of the skirt portion 20 for a short distance. The mounting portion thus configured is capable of sealing against the outer diameter of the upper rim of a cup about its entire circumference, provided that the cup has an outer diameter slightly greater than the undeformed minimum inner diameter of the skirt portion. In addition, a particularly good seal may be provided where the upper rim of the cup fits tightly into the mounting portion between the skirt portion 20 and the annular inner wall 22.

Located inwardly of the mounting portion 18 is a spacer 24 for enabling a plurality of lids 10 constructed according to the invention to be stacked without binding together, and a substantially horizontal support surface 26 located generally centrally of the lid. The preferred spacer 24 comprises an upwardly-opening channel which partially surrounds the support surface 26. In the illustrated embodiment, the spacer 24 is C-shaped as viewed in plan, and is substantially coextensive with a rim 28 which partially surrounds the support surface 26.

The spacer 24 is defined by an inner sidewall 30 and an outer sidewall 32. The inner sidewall 30 extends downward and outward from the rim 28 partially surrounding the support surface 26, and the outer sidewall 32 extends upward and slightly inward from the bottom of the inner sidewall 30.

At the upper end of the outer sidewall 32 is defined an annular seat 34 for receiving the lower end of the spacer of a lid located directly above the subject lid 10 in a stack. The seat 34 is defined by the inner wall 22 of the mounting portion and a narrow, generally horizontal surface 36 extending radially inward for a short distance from the bottom of the wall 22 to the upper end of the outer sidewall 32 of the spacer 24.

Figure 10:
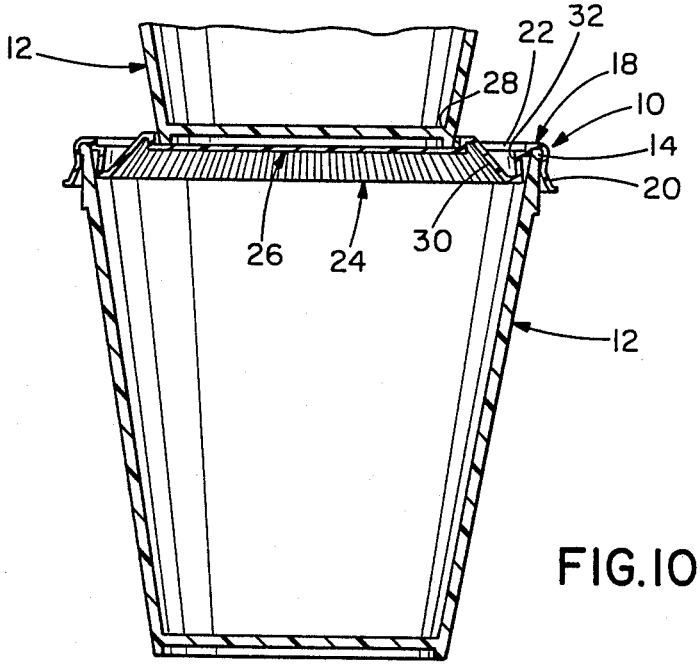
FIG. 10 is a sectional view illustrating the lid mounted on a cup and supporting a second cup on its upper surface.

The support surface 26 is configured for supporting the bottom of a cup as illustrated in FIG. 10, so that a plurality of cups equipped with lids according to the invention may be stacked atop one another in a relatively stable manner. The rim 28 which partially surrounds the support surface 26 aids in maintaining the bottom of a cup on the support surface 26. The rim 28 preferably is disposed at a predetermined radius from the center of the lid 10. The predetermined radius is slightly greater than the radius of the bottom of a cup on which the lid 10 is intended to be used.

In accordance with the invention, a removable tab 38 is defined in the lid 10 and extends into, and forms a part of, the support surface 26. The tab 38 includes a horizontal portion 40 which extends inwardly from the periphery of the lid between a pair of lines of weakness 42 and is coplanar with the support surface 26, a vertical portion 44 which extends downwardly at the inner end of the horizontal portion, and an arcuate section 46 of the mounting portion 18 of the lid 10.

A recess 48 is provided adjacent the vertical portion 44 of the tab 38, immediately inward thereof. The recess 48 preferably extends from the center of the lid 10 to the vertical portion 44 of the removable tab 38, and is substantially equal in width to the vertical portion of the tab 38. The support surface 26 is substantially planar over its entire area except for the recess 48. The recess 48 is located entirely within the radius defined by the rim 28, so that the bottom of a cup placed on the support surface 26 will be supported about its entire periphery.

The recess 48 is defined by a bottom wall 50 which slopes outward and downward from the center of the lid 10 between a pair of substantially vertical triangular sidewalls 52. The bottom wall 50 preferably has a relatively shallow slope, e.g., about 10° or 15°. The bottom wall 50 is generally rectangular, and at its lower end terminates at a slit 54 which separates the bottom wall 50 from the vertical portion 44 of the removable tab 38. The vertical portion 44 of the removable tab thus has a bottom edge 56 which terminates at the slit 54, and an upper end which joins the horizontal portion 40. The joint between the vertical portion 44 and the horizontal portion 40 of the removable tab 38 is a bendable fold line 56 which is generally linear and is perpendicular to a bisecting radius. The lines of weakness 42 extend generally radially outward from opposite ends of the fold line 56 so that the tab 38 increases in width toward the periphery of the lid 10.

Figure 6:
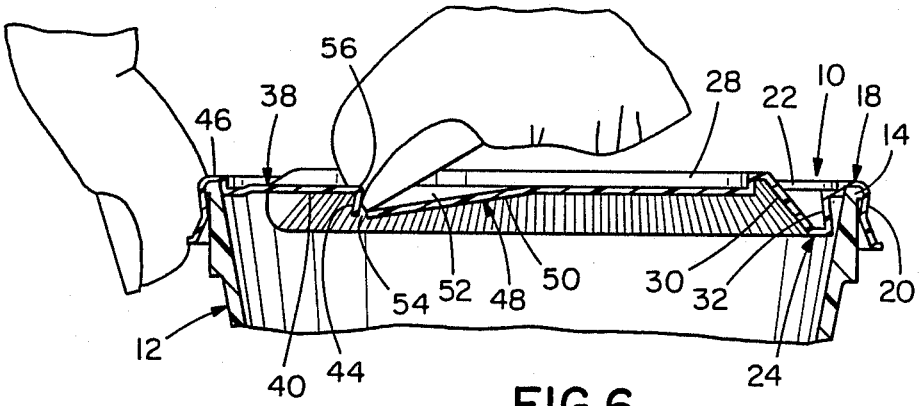
FIGS. 6 through 8 are partially diagrammatic, fragmentary sectional views illustrating a lid in accordance with the invention mounted on a a cup, and illustrating the removal of the removable tab from the lid.
Figure 7:
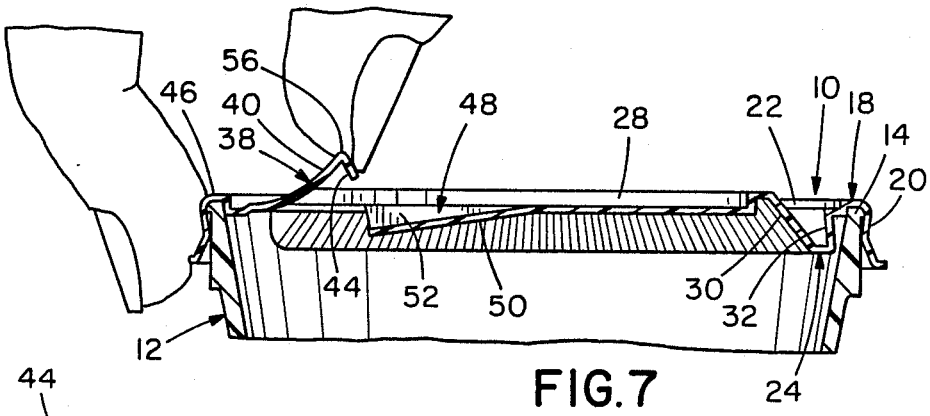
Figure 8:
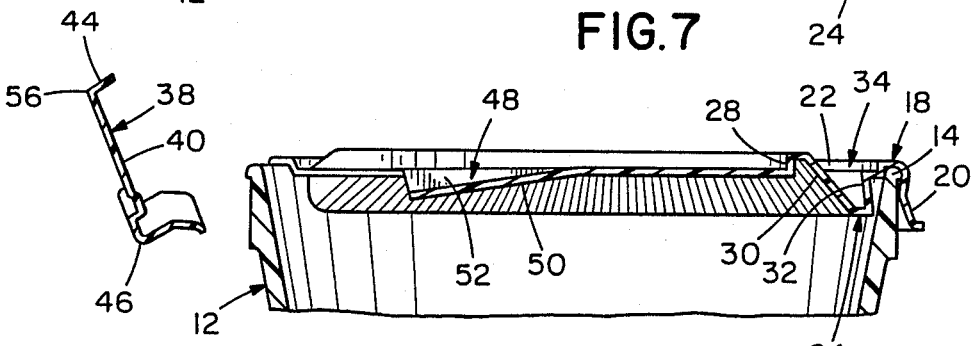
Figure 9:
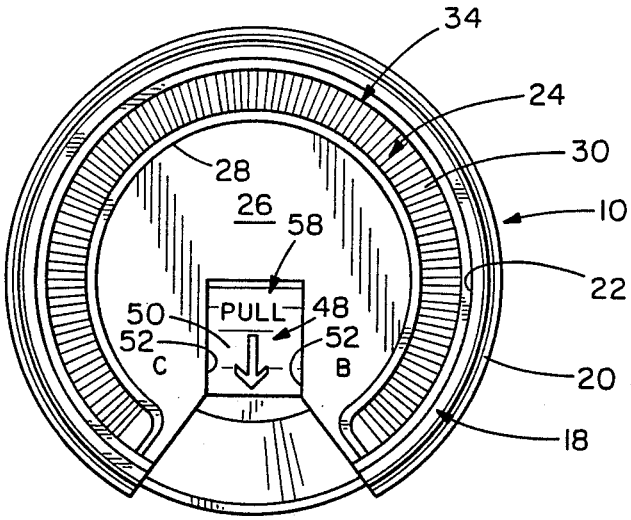
FIG. 9 is a plan view illustrating the lid with the tab removed.

As illustrated in FIGS. 6–8, to remove the tab 38, the user applies outward pressure to the vertical portion 44 of the tab 38, in a radially outward direction. The vertical portion 44 folds partially upward beneath the horizontal portion 40, folding about the joint 56, so that the tip of the user's thumb or finger may act as a wedge between the bottom wall 50 of the recess 48 and the removable tab 38, providing a mechanical advantage to aid in application of smooth, controlled upward and outward force to the tab, tearing it evenly and predictably along the lines of weakness in a controlled manner.

To aid the user in removing the tab 38, indicia 58 are preferably provided to indicate the direction in which force is to be applied to the tab 38 to remove it from the lid. The indicia 58 herein take the form of the word "pull" written on the sloping bottom wall 50 of the recess, with an arrow pointing outwardly toward the tab 38. This indicates to the user that he may apply a finger or thumb to the inner vertical wall of the removable tab and pull outwardly, in the direction indicated by the arrow, to remove it. The triangular sidewalls 52 may aid in centering the user's thumb or finger relative to the tab 38 during and prior to engagement therewith.

The lid 10 is preferably formed in a thermoforming operation from a thermoplastic material such as polystyrene or the like. The configuration of the lid as described above facilitates withdrawal of the lid from the mold used in the thermoforming operation. A lid according to the invention having satisfactory strength may be manufactured from a polystyrene sheet having a thickness of only about 0.020 in. or less.

The lines of weakness defining the tab 38 and the slit 54 at the bottom of the recess may be provided in a postforming operation. To facilitate removal of the tab 38, additional vertical slits 60, or lines of weakness may be provided at the ends of the vertical portion of the removable tab, extending between the slit 54 and the inner ends of the lines of weakness 42. As noted above, the lines of weakness 42 preferably extend toward the periphery of the lid 10. However, they need not extend through the skirt portion of the lid, and in the preferred embodiment of the invention, the lines of weakness terminate approximately at the top of the skirt portion. Similarly, the vertical slits or lines of weakness 60 need not extend the entire height of the vertical portion 44 of the tab 38, but may instead extend only part of this distance.

From the foregoing, it should be appreciated that the invention provides a novel and improved lid for drinking cups. The invention is not limited to the embodiment described above or any other particular embodiments, but is defined by the following claims.

What is claimed is:

1. An integral disposable plastic thermoformed drinking cup lid comprising:

a circular, peripheral downwardly-opening mounting portion for engaging the upper rim of a disposable cup, said mounting portion including a resilient, generally frustoconical peripheral skirt portion extending generally downward and outward about the periphery of said lid and an opposing annular inner wall extending downward and inward therefrom;

spacing means for preventing binding of said lid with adjacent lids when it is placed in a stack with lids of like configuration;

a substantially horizontal support surface which is free of upward projections and is located generally centrally of said lid for supporting an upstanding cup; and means for facilitating formation of a drinking opening in said lid, comprising a pair of lines of weakness in said lid defining a removable tab, and means defining a recess disposed inwardly of said tab to facilitate removal thereof;

said lines of weakness extending outward from a central portion of the lid to its outer edge;

said removable tab including a horizontal wall which is substantially coplanar with said support surface and has an inner end immediately adjacent said recess, and a substantially vertical wall having an upper edge joined to said substantially horizontal portion along said inner end thereof so as to form a substantially horizontal, bendable joint, said substantially vertical wall having a lower edge defined by a slit separating said substantially vertical wall from said recess.

2. A lid in accordance with claim 1 wherein said recess is defined by a generally rectangular bottom wall sloping downwardly toward the removable tab, and a pair of substantially vertical triangular sidewalls disposed parallel to one another on opposite sides of the sloping bottom wall.

3. A lid in accordance with claim 2 further comprising indicia on said bottom wall of said recess for instructing a user of the lid to pull radially outwardly on the tab to remove it.

4. A lid in accordance with claim 1 wherein said spacing means comprises an upwardly-opening channel which is generally C-shaped as viewed in plan and which is defined by an inner wall and an outer wall, said inner wall being corrugated and sloping downwardly and outwardly from said support surface, said outer wall extending generally vertically upward and slightly inward from the bottom of said inner wall.

5. A lid in accordance with claim 1 further comprising a raised border partially surrounding, said support surface.

6. A lid in accordance with claim 5 wherein said raised border is generally C-shaped, and extends through a circular arc of greater than 180°.

7. A lid in accordance with claim 1 wherein said means for facilitating formation of the drinking opening further comprises a pair of vertical slits, extending upward from opposite ends of the slit defining the lower edge of the vertical wall of the removable tab to the lines of weakness.

* * * * *